United States Patent [19]

McGourty et al.

[11] Patent Number: 4,810,014

[45] Date of Patent: Mar. 7, 1989

[54] MOTOR DRIVEN LOCK CONTROL

[76] Inventors: Thomas K. McGourty, 9670 Chimney Rock Rd.; Lawrence F. McGourty, 6680 Linne Rd., both of Paso Robles, Calif. 93446

[21] Appl. No.: 87,337

[22] Filed: Aug. 20, 1987

[51] Int. Cl.[4] ..... E05C 21/02

[52] U.S. Cl. ..... 292/144; 292/359

[58] Field of Search ..... 292/359, 144, 201, 96

[56] References Cited

U.S. PATENT DOCUMENTS 4,135,377 1/1979 Kleefeldt et al. ..... 292/144 X 4,390,197 6/1983 Butts ..... 292/144

4,736,970 4/1988 McGourty et al. ..... 292/359

*Primary Examiner*—Richard E. Moore

*Attorney, Agent, or Firm*—Fred N. Schwend

[57] ABSTRACT

The knob spindle of a self contained electrically controlled door lock is locked and unlocked by a unidirectional miniature electric motor. The motor drives a lock pawl to and from locking position through cyclically operable mechanism including an energy storing spring. The mechanism invariably operates through a cycle and, if the pawl is prevented from moving, energy will be stored in the spring to subsequently move the pawl, thereby preventing stalling of the motor and undue drain on the batteries.

13 Claims, 2 Drawing Sheets

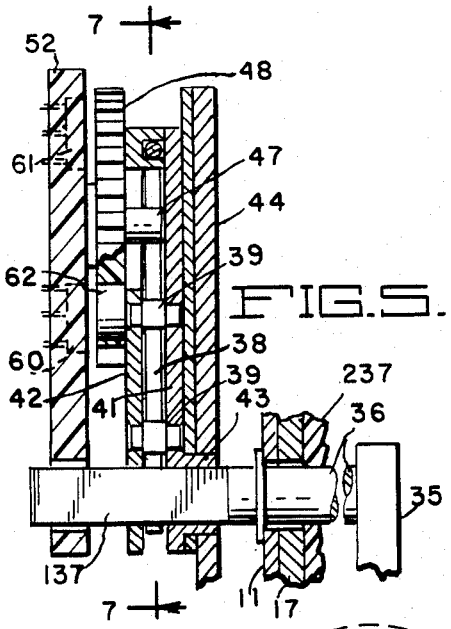
FIG. 5.
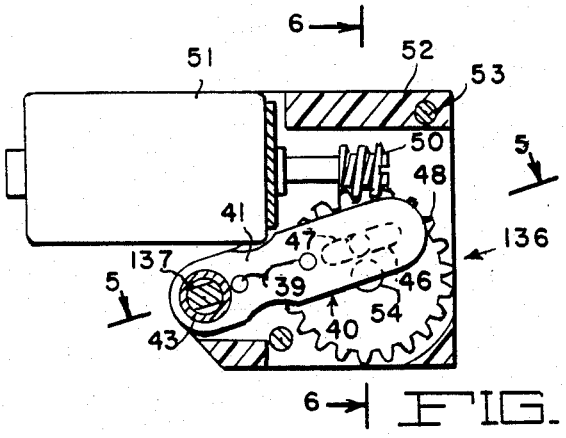
FIG. 4.
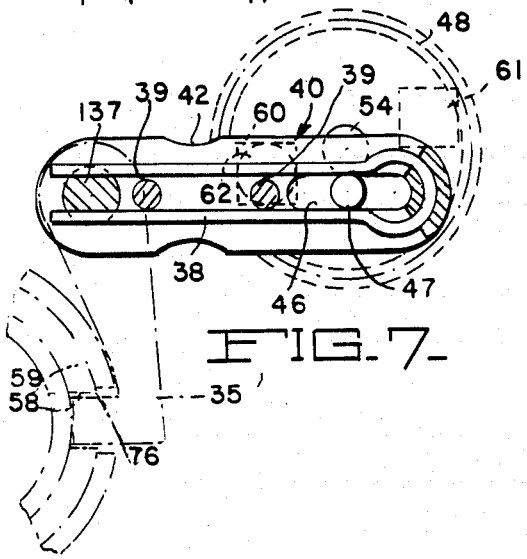
FIG. 7.
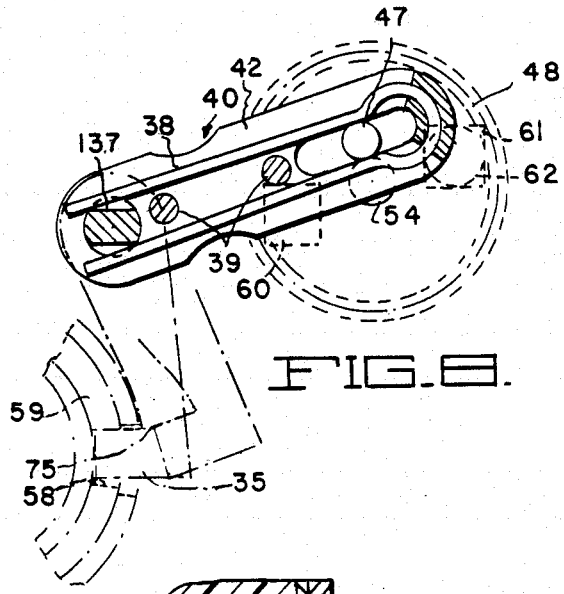
FIG. 8.
FIG. 9.
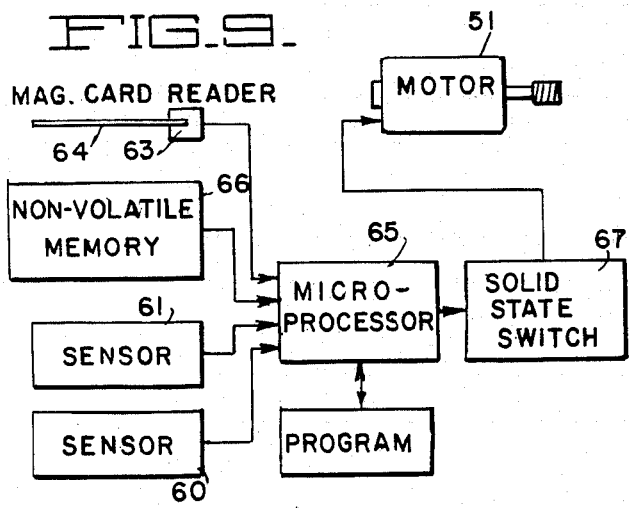
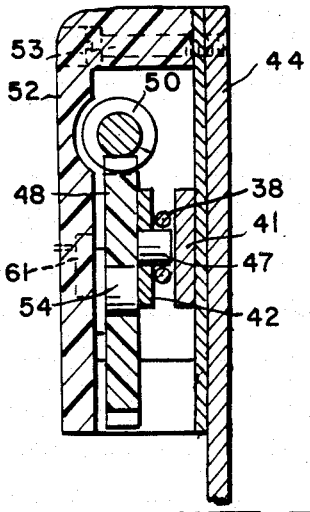
FIG. 6.

MOTOR DRIVEN LOCK CONTROL

BACKGROUND

1. Field of the Invention

This invention relates to locks and has particular reference to electrically controlled door locks such as those controlled by a magnetically encoded card or a push button combination in which buttons must be pressed in a predetermined order to effect release of the lock.

2. Description of the Prior Art

Door locks, particularly of the key controlled type, are generally of standard size and fit in a standard size opening in a door. Thus, they are generally interchangeable.

On the other hand, electrically controlled door locks, are of particular advantage in high security situations, hotels, etc., where keys normally used to open the usual key locks, may be readily copied, or the locks may be readily picked, to enable unauthorized access to otherwise secure locations. However, such electrically controlled locks are generally quite bulky and are of a larger size than key controlled locks, requiring special size door lock openings, so that they are not easily interchangeable with key locks. Further, electrically controlled locks normally require relatively large power supplies thus rendering it impractical to provide a self contained lock unit with batteries incorporated therein, but require instead, electrical power from an external source with conductors leading to the lock unit.

In our copending applications, U.S. Pat. Nos. 4,754,625, issued on July 5, 1988 and 4,736,970, issued on Apr. 12, 1988. We have disclosed and claimed electrically controlled locks which require only relatively low powered electrical pulses for operation, using miniature or so called "AA" batteries or the like. This allows the lock unit to be interchangeable with a standard key lock.

Although such latter locks operate satisfactorily, they require electromagnets to effect the unlocking functions, and we have discovered that when the batteries have been discharged to a certain level, say 50% or less of their fully charged capacity, the resulting drop in voltage tends to make the electromagnets unreliable, apparently due to the relatively large magnetic gap between the pole pieces of the electromagents. We have further discovered that the use of a miniature electric motor in lieu of an electromagnet will enable the lock unit to be operated at much lower battery charge levels and thus tolerate a greater degree of exhaustion of the batteries before becoming unreliable. Certain other problems, however, are presented. For example, if the motor should become stalled due to advertent or inadvertent manipulating or holding of the lock release spindle knob by the operator, a heavy current drain of the batteries will ensue.

Accordingly, a principal object of the present invention is to provide a self contained electrically controlled lock unit which overcomes the above noted problems.

Another object is to provide an electrically controlled lock unit utilizing miniature batteries which can be reliably operated even when the batteries are appreciably discharged.

Another object is to provide an electrically controlled lock unit, utilizing an electric motor, which will fit within a standard size key lock door opening.

Another object is to provide an electrically operable control unit which can be incorporated in a commercially available door lock mechanism with a minimum amount of modification.

A further object is to provide an electrically controlled door lock unit which is simple and inexpensive to manufacture and install.

According to the invention, and in a door lock unit of the type comprising a pair of coaxially extending interior and exterior door knob spindles, each effective to actuate a lock bolt retractor independently of the other, a novel electrical lock control is provided comprising a locking pawl for one of the spindles. The pawl is driven between locking and unlocking positions by a miniature motor drive mechanism through an energy storing spring. The motor operates in one direction only and the mechanism operates through a cycle each time an actuating signal is received from a control device such as a magnetic card reader, a combination push button circuit or the like.

The cyclic drive mechanism operates through a split cycle, and during the first phase of the cycle, it normally actuates the pawl to an unlocking position but if the operator should attempt to rotate the knob spindle during such time, the pawl will usually be held in locking position by frictional engagement with the knob spindle but the drive mechanism will continue to operate through its first phase to a mid point of the cycle, storing energy in the spring without stalling the motor. At such time the motor will be deenergized and when the operator releases the knob spindle, the spring will become effective to move the lock pawl to unlocking position.

After a predetermined time period, the motor will again be energized to rotate in the same direction to actuate the drive mechanism through the second phase of its cycle to normally return the lock pawl to locking position. However, if the operator should hold the knob spindle in lock opening position during the second phase, the pawl will be prevented from moving into its locking position by the spindle but the drive mechanism will, nevertheless, continue to the end of its cycle without stalling the motor, thus storing engergy in the spring until the operator releases the knob spindle, whereupon the spring will return the pawl to locking position.

BRIEF DESCRIPTION OF THE DRAWINGS

The manner in which the above and other objects of the invention are accomplished will be understood on reference to the following specification when read in conjunction with the accompanying drawings, wherein:

FIG. 4 is a transverse sectional view taken along line 4—4 of FIG. 1, illustrating the lock pawl drive mechanism.

FIG. 5 is an enlarged sectional view taken along line 5—5 of FIG. 4.

FIG. 6 is an enlarged sectional view taken along line 6—6 of FIG. 4.

FIG. 7 is an enlarged sectional view taken along line 7—7 of FIG. 5 showing the drive mechanism in full cycle position and the locking pawl in locking position.

FIG. 8 is a view similar to that of FIG. 7 but showing the drive mechanism in mid cycle position.

FIG. 9 is a schematic electrical diagram of circuitry for controlling the motor.

DESCRIPTION OF THE PREFERRED EMBODIMENT

Figure 1:
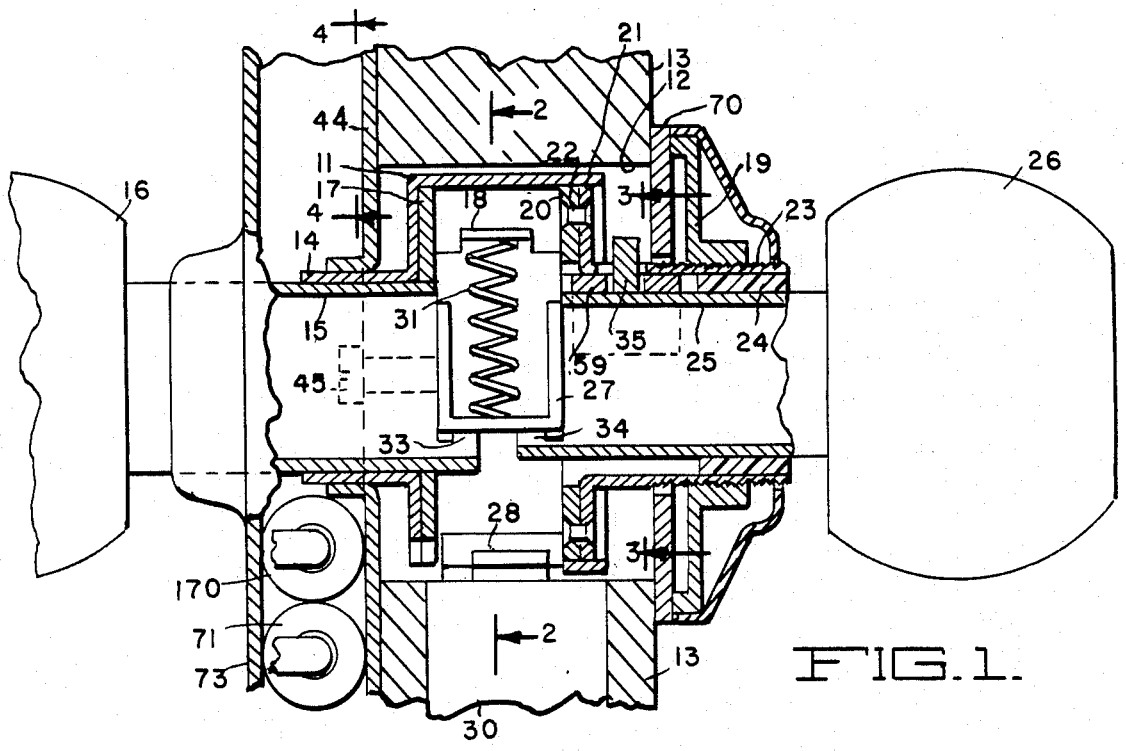
FIG. 1 is a sectional plan view of a door lock and part of a door, embodying a preferred form of the present invention.

While this invention is susceptible to embodiment in many different forms, there is shown in the drawings, and will be described, a preferred embodiment with the understanding that the present disclosure is to be considered as an exemplificaton of the principles of the invention and is not intended to limit the invention to the embodiment illustrated.

Referring to the drawings, parts of the basic door lock mechanism disclosed therein are found in the commercially available door lock manufactured by Schage Lock Co. and basically disclosed, for example, in U.S. Pat. No. 2,834,194 issued on May 13, 1958. However, basic door lock mechanisms, manufactured by other firms can also be used.

Figure 2:
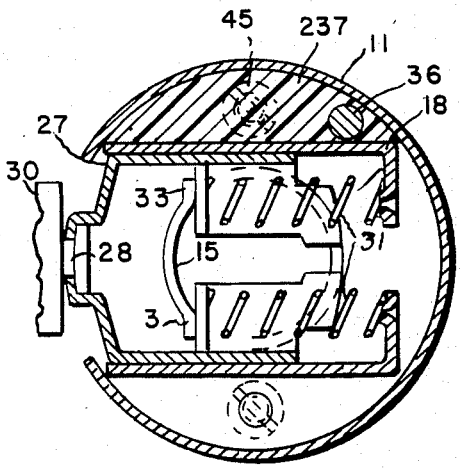
FIG. 2 is a transverse sectional view taken along line 2—2 of FIG. 1.
Figure 3:
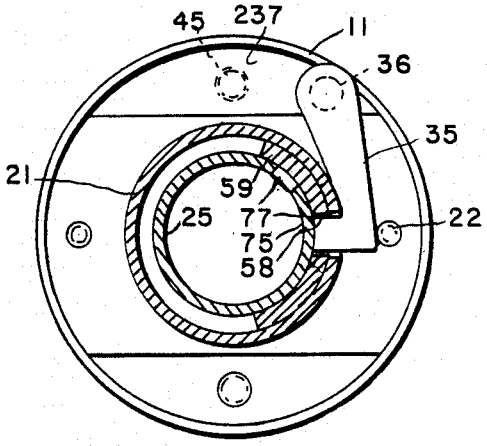
FIG. 3 is a transverse sectional view taken along line 3—3 of FIG. 1.

The basic lock mechanism disclosed comprises a cylindrical lock frame or body 11 (FIGS. 1 to 3) arranged to fit within a standard size lock bolt bore 12 formed in a door 13. The frame 11 is reduced in diameter at 14 at one end to form a bearing for a hollow interior knob spindle 15 to which an interior knob 16 is suitably attached, the knob being located on the interior side of the door. An annular wall 17 is suitably secured to the lock frame and is also secured to one end of a cross member 18.

A second annular wall 20 is suitably secured to the opposite end of the cross member 18 and has a flanged hub 21 secured thereto by rivets 22. The hub 21 is formed with screw threads 23 to receive a clamp nut 19. The hub 21 also rotatably supports a hollow exterior spindle 25, coaxial with spindle 15, through a bearing bushing 24, the spindle 25 being secured to an exterior knob 26.

A bolt retractor slide 27 is connected at 28 to a door latch bolt 30 and is slidably supported by member 18. Compression springs 31 interposed between part of the cross member 18 and part of the retractor 27 cause the latter to normally hold the latch bolt 30 in door locking position.

Camming ears 33 on the interior spindle 15 are effective upon rotation of the spindle to retract the slide 27 and bolt 30. Similarly, camming ears 34 on the exterior knob spindle 25 are effective upon rotation of the spindle to withdraw the lock bolt 30.

In accordance with the present invention, a lock pawl 35 (FIGS. 1 and 5 to 8) operable by a motor driven mechanism generally indicated at 136 is provided to normally lock the exterior knob spindle 25 against rotation in either direction.

The pawl 35 is suitably secured to one end of a shaft 36 journalled in a bearing block 237 suitably secured within the lock frame 11. The shaft 36 is flattened at 137 at its opposite end to form a substantially rectangular cross section which fits between the opposite legs of a hairspring 38. The spring 38 is carried by an oscillating arm assembly generally indicated at 40 and comprising a pair of pivot arms 41 and 42 held in spaced relation on opposite sides of the spring 38 by a pair of studs 39.

The arm assembly 40 is pivotal about the axis of shaft 36. For this purpose, arm 41 has a bearing boss 43 journaled in a bearing formed in a drive mechanism mounting plate 44 secured to the lock frame 11 by screws 45 (FIG. 1). Arms 41 and 42 are freely pivotal over the flattened section 137 of shaft 36.

The arm 42 has a bearing slot 46 therein fitting over a pin 47 eccentrically mounted on the side of a non-metallic worm gear 48 rotatable by a gear worm 50 carried by the drive shaft of a miniature DC motor 51 suitably mounted on the mounting plate 44.

A non-metallic housing 52 is secured to the mounting plate 44 by screws 53 and carries a fixed pin 54 on which the worm gear 48 is rotatably mounted.

It will be seen from the above that when the motor 51 is energized, the gear 48 will carry the pin 47 in a circular orbit to oscillate the arm assembly 40 between its two extreme positions shown in FIGS. 7 and 8, thus normally oscillating the shaft 36 to move the pawl 35 from a locking position shown in FIG. 7, wherein it engages in a notch 58 in an arcuate shoe or insert 59 (see also FIGS. 1 and 3) on the spindle 25, to an unlocking position shown in FIGS. 4 and 8 where it extends clear of the notch 58, enabling the exterior lock spindle 25 to be rotated.

It should be noted that the pawl 35 and insert 59 are formed of hardened steel alloy or the like which are more wear resistant than the material of the spindle to eliminate wear at interengaging shoulders or edges of these elements, i.e., 75 (FIG. 8) of the pawl and 76 (FIG. 7) of the notch of the insert. The insert 59 is located in place on the spindle 25 by means of a projection 77 on the insert which fits in a mating hole in the spindle and is retained on the spindle by virtue of its fitting within the bearing formed by the flanged hub 21.

Referring to FIGS. 5, 7 and 8, two magnetically controlled sensors 60 and 61 are embedded in the wall of the housing 52 on diameterically opposite sides of the bearing pin 54. Such sensors are preferrably of the well known "Hall" type and are located adjacent the path of a permanent magnet 62 embedded in the worm gear 48. The magnet 62 is so located that when the drive mechanism 136 is in its full cycle position shown in FIG. 7, the magnet will be located opposite the sensor 60 to transmit a signal to a microprocessor 65 (FIG. 9), as will be described presently, whereas when the drive mechanism is in its mid cycle position shown in FIG. 8, the magnet 62 will be located opposite sensor 61 to transmit a second signal to the microprocessor.

The invention is disclosed in association with an encoded magnetic card reader 63 (FIG. 9) to effect locking and unlocking functions. When a magnetically encoded card 64 is passed through the reader, data signals will be transmitted to the microprocessor 65 where they are compared with information set up in a memory unit 66. When a comparison is made, a signal will be transmitted by the microprocessor, through a switching circuiting 67, to energize the motor 51. Accordingly, the worm gear 48 will be rotated counterclockwise from its full cycle position of Fig. 7, thus rocking the arm assembly 40 counterclockwise to normally withdraw the pawl 35 from locking position. However, if the operator should be attempting to turn the exterior knob 26 during this time, the frictional engagement between the pawl 35 and the edge of notch 58 will prevent withdrawl of the pawl and the spring 38 will yeild but the motor will continue to drive the arm assembly 40 until it reaches its mid cycle position of FIG.

8 whereat the magnet 62 causes the sensor 61 to transmit a signal to the microprocessor 65 to deenergize the motor for a predetermined time period, for example, 5 seconds. If during this time, the operator releases the knob 26, the now tensioned spring 38 will be effective to cam against the flattened shaft section 137 to withdraw the pawl. Also, during such time, the operator is free to operate the exterior knob 26 to release the door lock. At the end of such time period, the microprocessor 65 will again transmit a signal to energize the motor 51 to continue driving the worm gear 48 counterclockwise through the second phase of the cycle from its mid point shown in FIG. 8 to its full cycle position shown in FIG. 7, thus returning the pawl to its locking position of FIG. 7. As the worm gear 48 moves into full cycle position, the magnet 62 will cause the sensor 60 to transmit a signal to the microprocessor to deenergize the motor.

If, during return of the mechanism to full cycle position, the operator holds the exterior knob in lock releasing position, the pawl 35 will limit against the outer surface of the spindle insert 59 and the spring 38 will yeild as the worm gear 48 and arm assembly 40 move to their full cycle positions of FIG. 7. However, when the exterior knob 26 is released by the operator, the springs 31 will return the spindle 25 and the spring 38 will be enabled to rock the pawl 35 into locking position.

The card reader 63 is preferably mounted on the exterior side of the lock and for this purpose it is mounted in a manner not shown on an apertured plate 70, (FIG. 1) fitted on the hub 21 and clamped in place against the side of the door 13 by the aforementioned nut 19.

Miniature batteries 170 and 71 which are preferably of the 1.5 volt, type AA size are mounted within a suitable compartment 73 suitably secured to the mounting plate 44. Thus, the lock control circuit of FIG. 9 may be largely contained within the compartment 73.

It will be noted that other forms of coded input devices, such as combination push button switches, could be readily substituted for the card reader 63.

From the above, it will be noted that a simple, inexpensive and compact electric lock control mechanism is provided, utilizing a undirectional motor energized by relatively low levels of electric current to move the lock pawl into and out of locking position. Since the motor is driven in one direction only throughout the cycle, a very simple and reliable motor circuitry and control is provided. Also, it will be seen that the lock unit may be readily interchanged with a standard key lock and may be easily adjusted by means of the clamp nut 19 to fit doors of different thicknesses.

We claim:

1. An electrically controlled door lock comprising a rotatable knob spindle effective upon rotation to release said lock, a locking element moveable between a spindle locking position and a spindle unlocking position, an electric motor, a cyclically operable drive mechanism operable through a cycle by said motor, said mechanism being operable through a mid cycle condition in said cycle, means operable by said drive mechanism during a portion of said cycle prior to said mid cycle condition for moving said locking element from said locking position to said unlocking position and operable during a portion of said cycle after said mid cycle condition for moving said locking element to said locking position, and means for deenergizing said motor for a predetermined time period in said mid cycle condition.

2. An electrically controlled door lock as defined in claim 1 wherein said motor includes means for rotation in the same direction throughout said cycle.

3. A electrically controlled door lock as defined in claim 1 wherein said drive mechanism comprises a yieldable energy storing device for transmitting movement from said motor to said locking element to move said locking element between said locking and unlocking positions.

4. An electrically controlled door lock as defined in claim 1 wherein said energy storing device comprises a spring.

5. An electrically controlled door lock comprising a rotatable knob spindle effective upon rotation to release said lock, a locking element moveable between a spindle locking position and a spindle unlocking position, an electric motor, a cyclically operable drive mechanism operable by said motor and effective upon movement from a full cycle position and prior to a mid cycle condition to normally move said locking element to said unlocking position and effective after said mid cycle condition to normally move said locking element to said locking position, and means for deenergizing said motor for a predetermined time period in said mid cycle condition, said drive mechanism comprising a yieldable energy storing device effective to transmit movement from said motor to said locking element and effective to yield when said locking element is prevented from moving to said unlocking position, said energy storing device being effective when said drive mechanism is in said mid cycle condition to move said locking element to said unlocking position.

6. An electrically controlled door lock as defined in claim 5 wherein said energy storing device is effective to yield when said locking device is prevented from moving to said locking position, said energy storing device being effective when said drive mechanism is in said full cycle position to move said locking element to said locking position.

7. An electrically controlled door lock as defined in claim 5 wherein said motor includes means for rotation in one direction only; said drive mechanism comprising an oscillating device, and means operable by said motor to move said oscillating device in one direction during a portion of said cycle prior to said mid cycle condition and to move said oscillating device in the opposite direction during a portion of said cycle following said mid cycle condition.

8. An electrically controlled door lock as defined in claim 6 wherein said yieldable energy storing device is effective to yield when said oscillating device moves in said one direction and said locking device is prevented from moving to said unlocking position, said energy storing device being effective when said drive mechanism moves into said mid cycle condition to move said locking element to said unlocking position.

9. An electrically controlled door lock as defined in claim 7 wherein said yieldable energy storing device is effective to yield when said oscillating device is moved in said opposite direction and said locking element is prevented from moving to said locking position, said energy storing device being effective when said drive mechanism moves into said full cycle position to move said locking element into said locking position.

10. An electrically controlled door lock comprising a rotatable knob spindle effective upon rotation to release said lock, a locking element moveable between a spindle locking position and a spindle unlocking position, an electric motor including means operable in one direction only, an oscillating device connected to said locking element, means operable by said motor for oscillating said device in one direction and thereafter in the opposite direction, said device including an energy storing device effective to move said locking element from said locking position to said unlocking position during movement of said device in said one direction and to move said locking element from said unlocking position to said locking position during movement of said device in the opposite direction, said energy storing device being effective to yield and to thereafter move said locking element between said locking position and said unlocking position.

11. An electrically controlled door lock as defined in claim 10 wherein said energy storing device comprises a spring.

12. An electrically controlled door lock as defined in claim 10 comprising a bearing for said spindle, an insert secured to said spindle, said insert being interposed between said spindle and said bearing, said insert being of relatively harder material than the material of said spindle, and means on said insert forming a shoulder engagable with said locking element.

13. An electrically controlled door lock as defined in claim 10 comprising an arcuate insert fitted over said spindle, means interconnecting said insert and said spindle, said insert being of a relatively harder material than the material of said spindle, and means on said insert forming a shoulder engagable with said locking element.

* * * * *